United States Patent [19]

Stubblefield

[11] 4,372,058

[45] Feb. 8, 1983

[54] SHOE SOLE CONSTRUCTION

[76] Inventor: Jerry D. Stubblefield, 12225 NW. Big Fir Ct., Portland, Oreg. 97229

[21] Appl. No.: 185,957

[22] Filed: Sep. 10, 1980

Related U.S. Application Data

[63] Continuation of Ser. No. 935,584, Aug. 21, 1978, abandoned, which is a continuation-in-part of Ser. No. 853,482, Nov. 21, 1977, abandoned.

[51] Int. Cl.[3] ..... A43B 13/04; A43B 13/18; A43B 13/26; A43B 5/00

[52] U.S. Cl. ..... 36/32 R; 36/59 C; 36/67 A; 36/114; D2/321

[58] Field of Search ..... 36/32 R, 59 R, 59 A, 36/59 C, 59 B, 30 R, 25 R, 114, 128, 129, 67 A, 28; D2/319–322

[56] References Cited

U.S. PATENT DOCUMENTS

| | | | |
|---|---|---|---|
| D. 185,462 | 6/1959 | Ratner . | |
| D. 208,248 | 8/1967 | Ford . | |
| D. 232,277 | 8/1974 | Vargo . | |
| D. 244,642 | 6/1977 | Famolare, Jr. . | |
| D. 248,428 | 7/1979 | Watanabe . | |
| 407,609 | 7/1889 | Pratt | 36/25 R |
| 411,776 | 10/1889 | Beattie | 36/25 R |
| 671,358 | 4/1901 | Taylor | 36/59 R |
| 1,351,291 | 8/1920 | Hornquist . | |
| 1,458,201 | 6/1923 | Stedman | 36/59 C |
| 1,605,947 | 11/1926 | Heady . | |
| 1,962,526 | 6/1934 | Riddell . | |
| 1,988,784 | 1/1935 | Carrier | 36/59 C |
| 2,038,972 | 4/1936 | Watanabe | 36/32 R |
| 2,071,431 | 2/1937 | Riddell | 36/59 C |
| 2,211,057 | 8/1940 | Duckoff . | |
| 2,627,676 | 2/1953 | Hack . | |
| 2,833,057 | 5/1958 | Hack . | |
| 2,885,797 | 5/1959 | Chrencik | 36/32 R |
| 2,981,011 | 4/1961 | Lombardo . | |
| 3,061,952 | 11/1962 | Prohaska . | |
| 3,100,354 | 8/1963 | Lombard et al. . | |
| 3,316,662 | 5/1967 | Schmadeke . | |
| 3,463,165 | 8/1969 | Goodman . | |
| 3,470,879 | 10/1969 | Meiller . | |
| 3,494,055 | 2/1970 | McSorley . | |
| 3,507,059 | 4/1970 | Vietas . | |
| 3,532,098 | 10/1970 | Rodenberger . | |
| 3,717,943 | 2/1973 | Orndorff, Jr. . | |
| 3,793,750 | 2/1974 | Bowerman | 36/59 C |
| 3,808,713 | 5/1974 | Dassler . | |
| 3,818,617 | 6/1974 | Dassler et al. . | |
| 4,043,058 | 8/1977 | Hollister et al. | 36/67 A |
| 4,043,058 | 8/1977 | Hollister et al. . | |
| 4,045,888 | 9/1977 | Oxenberg . | |
| 4,060,917 | 12/1977 | Canale . | |
| 4,083,125 | 4/1978 | Benseler | 36/59 C |
| 4,085,527 | 4/1978 | Riggs . | |
| 4,096,649 | 6/1978 | Saurwein . | |
| 4,128,950 | 12/1978 | Bowerman et al. | 36/59 C |

FOREIGN PATENT DOCUMENTS

| | | | |
|---|---|---|---|
| 202570 | 11/1955 | Australia . | |
| 231840 | 1/1960 | Australia . | |
| 261488 | 7/1960 | Australia . | |
| 62507 | 3/1973 | Australia . | |
| 68058 | 11/1975 | Australia . | |
| 71980 | 5/1977 | Australia . | |
| 1634279 | 10/1951 | Fed. Rep. of Germany . | |
| 962584 | 4/1957 | Fed. Rep. of Germany | 36/59 C |
| 2618588 | 11/1977 | Fed. Rep. of Germany . | |
| 871880 | 1/1942 | France . | |
| 50-9142 | 1/1975 | Japan . | |
| 51-85843 | 7/1976 | Japan . | |
| 51-150442 | 12/1976 | Japan . | |
| 211107 | 11/1940 | Switzerland | 36/59 C |
| 239944 | 3/1946 | Switzerland | 36/59 R |
| 328731 | 5/1958 | Switzerland | 36/32 R |
| 302111 | 12/1928 | United Kingdom | 36/32 R |
| 629917 | 10/1978 | U.S.S.R. | 36/28 |

*Primary Examiner*—James Kee Chi

*Attorney, Agent, or Firm*—Saidman, Sterne & Kessler

[57] ABSTRACT

A shoe sole having a tread preferably defining a longitudinally and/or laterally oriented concavity with the lower extremities of the sole embodied in downwardly and outwardly disposed flexible lugs to cushion the foot against impact loads. The tread members are preferably inclined at an obtuse angle to the lower surface of the sole for spreading outwardly upon impact with the ground to dissipate the impact forces outwardly away from the foot and leg of the wearer. Rows of lugs may be spaced inwardly from the sole edges of a lesser vertical dimension than the outermost lugs and serve to supplement cushioning. A web extends between some of the outer lugs to reinforce same against load deflection. Further, the outer lugs may be of non-uniform lateral dimension at the heel portion of the sole.

43 Claims, 12 Drawing Figures

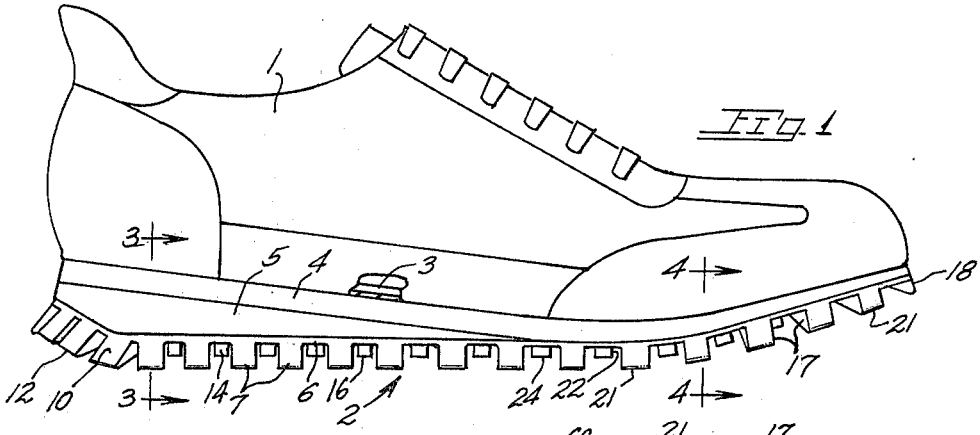
Fig. 1
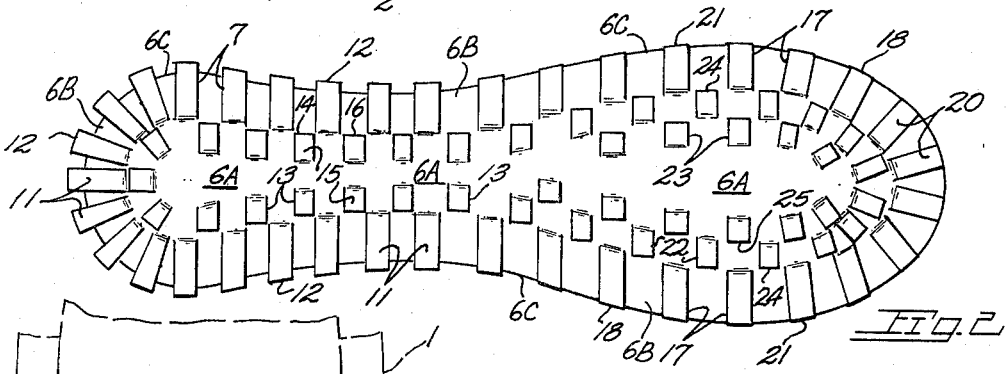
Fig. 2
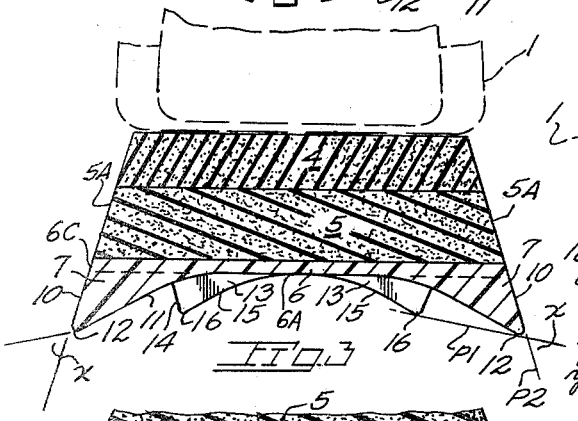
Fig. 3
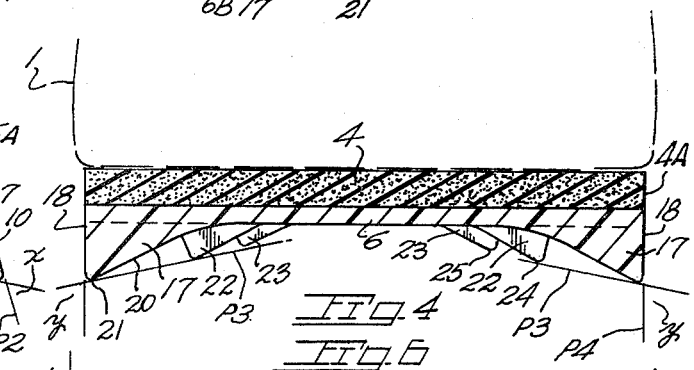
Fig. 4
Fig. 6
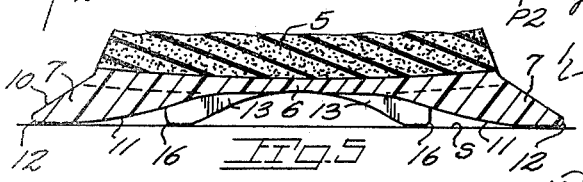
Fig. 5
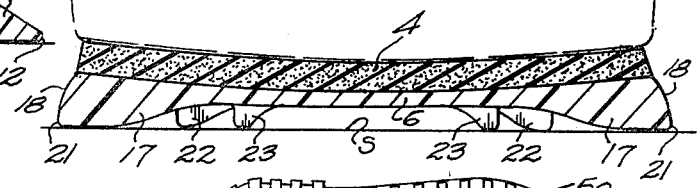
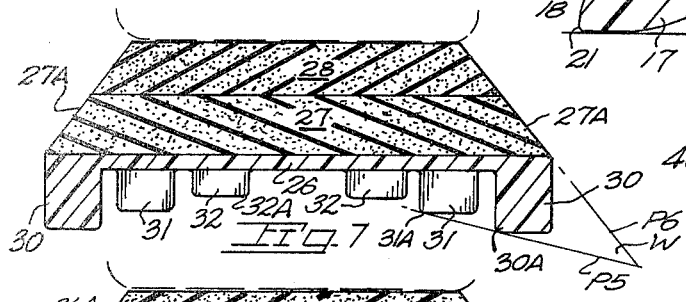
Fig. 7
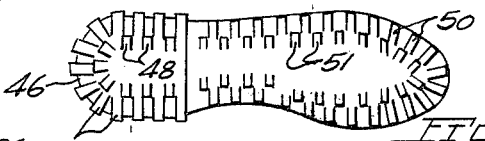
Fig. 10
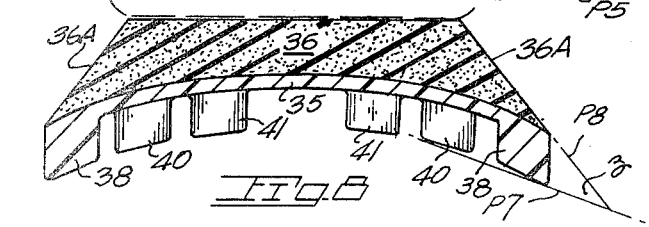
Fig. 8
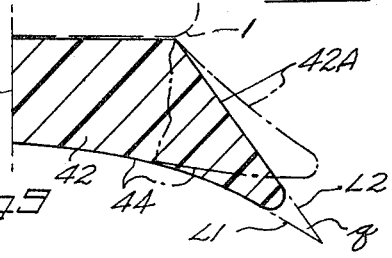
Fig. 9

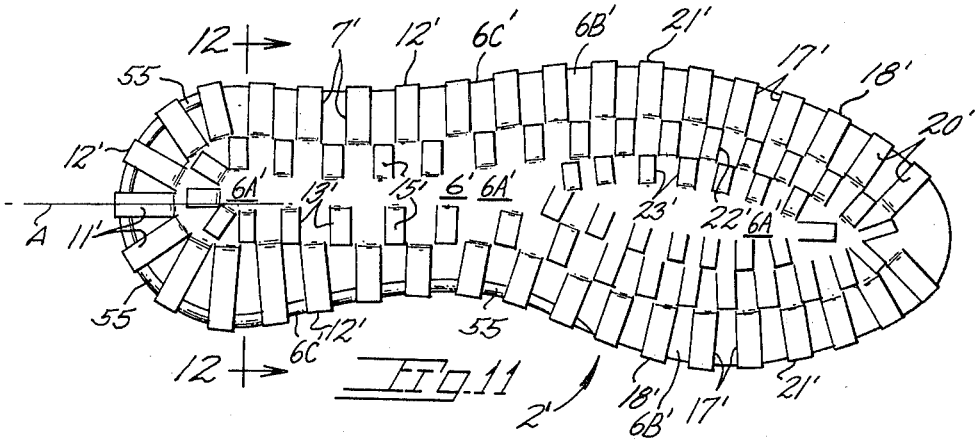
FIG. 11
FIG. 12
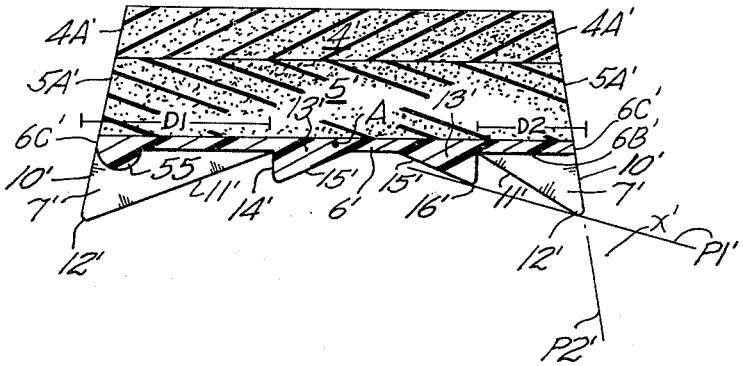

SHOE SOLE CONSTRUCTION

This is a continuation of application Ser. No. 935,584 filed Aug. 21, 1978, now abandoned, which is a continuation-in-part of application Ser. No. 853,482 filed Nov. 21, 1977, now abandoned.

BACKGROUND OF THE INVENTION

The present invention relates generally to shoes and specifically to shoe sole construction. The increased popularity of competitive and recreational running, witnessed in the last few years, has resulted in the introduction of a wide variety of athletic shoe designs wherein shoe upper and sole constructions have embodied changes directed toward specific objectives. For example, in the prior art is shoe sole construction having "flared" side edges extending continuously about the heel portion ostensibly for supplementing heel stability, and sole constructions with tread designs directed toward minimizing impact loads on the foot and leg.

To the extent the prior art is known, efforts have been made to provide soles for athletic shoes with the sole having cupped tread surfaces with the outer tread surfaces being continuous in order to affect a momentary seal between the sole and floor for traction purposes. Examples of such efforts are found in indoor type athletic shoes in U.S. Pat. Nos. 1,962,526 and 2,071,431. Neither of the foregoing patents disclose multiple lug series in proximity of both sole edges. Additionally, U.S. Pat. No. 3,100,354 discloses a shoe sole having a lengthwise orientated concavity but significantly different from the present invention in that the concavity is laterally defined by flat sole surfaces of considerable width, and in similarity to the first mentioned patents does not utilize laterally spaced series of tread components with each series of an effective different height. U.S. Pat. No. 4,085,527 shows intermingled cleats.

SUMMARY OF THE PRESENT INVENTION

The present invention is embodied in sole construction wherein sole components are intended to provide, among other objectives, desired cushioning of the wearer's foot and leg regardless of the surface run on to reduce impact loads and the chance of foot or leg injuries to the wearer.

The present sole construction benefits from a lengthwise orientated concave shape extending along the shoe sole with the composite surfaces of the sole tread defining the concavity. The lower extremities of the tread are adapted to flex upwardly and outwardly relative to the shoe upper upon ground contact. Accordingly a central portion of the outer sole directly below the foot is supported in cantilever fashion by the tread and resiliently cushions the foot as the shoe comes into maximum ground contact. As greater impact loads are encountered by the heel portion of the shoe, this feature is particularly important when embodied within the heel. The forward portion of the sole underlying the forefoot and ball of the foot, while not subjected to as great impact forces, does bear greater overall loads during running, which loads are resiliently supported by the forward tread portion of the present sole while importantly providing the sole flexibility desired.

While the present invention is shown and described in conjunction with an athletic shoe, such is not intended to imply limited use of same but rather the present sole construction may be further utilized in other footwear as later elaborated upon.

Important objectives of the present invention include: the provision of a sole the tread of which defines a lengthwise oriented concavity which concavity also extends laterally to the sole edges; the provision of a sole wherein the outer series of lugs are inclined downwardly and outwardly to provide a highly resilient tread adapted to flex upwardly, and in some instances outwardly, relative to the shoe upper during ground contact to thereby cushion the foot; the provision of a shoe sole permitting uneven compression of sole lugs during asymmetrical loading during execution of a turn by a runner; the provision of a sole having a high degree of stability even on uneven ground surfaces or surfaces having loose gravel or other obstructions thereon; the provision of shoe sole construction having inner and outer series of lugs with some of the lugs of the outer series interconnected by a web to reinforce the joined lugs against load deflection to reduce ankle pronation; the provision of shoe sole construction wherein the lugs of an outer series located along the sole margin are of non-uniform length to better accommodate loads applied thereto without severe distortion to inhibit ankle pronation; the provision of shoe sole construction having an inner and an outer series of lugs with the inner series of lugs disposed asymmetrically of a sole major axis.

BRIEF DESCRIPTION OF THE DRAWING

In the accompanying drawing:

FIG. 1 is a side elevational view of a shoe embodying the present sole improvements;

FIG. 2 is a bottom plan view of FIG. 1;

FIGS. 3 and 4 are sectional views taken along lines 3—3 and 4—4 of FIG. 1 showing the transverse configurations of heel and forefoot sole portions;

FIGS. 5 and 6 correspond to FIGS. 3 and 4 and show the sole heel and forefoot sole portions in ground contact;

FIG. 7 is a sectional view of a modified sole construction;

FIG. 8 is another sectional view of a further form of modified sole construction;

FIG. 9 is a sectional view of still another form of modified sole construction;

FIG. 10 is a plan view of a distinct shoe sole and heel embodying the present invention;

FIG. 11 is a bottom plan view of shoe sole construction embodying the present invention; and FIG. 12 is a sectional view taken along line 12—12 of FIG. 11 rotated through ninety degrees.

DETAILED DESCRIPTION OF THE PREFERRED EMBODIMENT

With continuing attention to the drawing, the reference numeral 1 indicates the upper of an athletic shoe customarily fabricated from stitched fabric or leather pieces. The particular construction of the upper is not part of the present invention and, accordingly, further details of same are superfluous.

The present sole construction is indicated generally at 2 and includes a tread or that portion of the sole coming into ground contact. Customarily, athletic shoes of the type shown have soles including an insiole 3, a resilient mid-sole 4, a resilient heel wedge 5 and an outer sole 6 defined by a lower surface generally having a central portion 6A, a peripheral portion 6B and an outer edge 6C. The upper 1 and mid-sole 4 are typically bonded to one another by an adhesive, as is the outer sole 6 to the mid-sole 4 and heel wedge. In athletic shoes it is further typical to form the heel portion of outer sole 6 integral with the forefoot portion of the sole with the combined portions constituting the shoe sole tread.

With attention first to the heel portion of the sole, approximately the left hand half of the sole as viewed in FIG. 2, said heel portion, as typically shown in FIG. 3, includes an outer series of resilient tread members, components or lugs 7 that extend integrally from peripheral portion 6B of the lower surface of outer sole 6, each tread member having converging outwardly and downwardly inclined portions or walls (relative the sole major axis) at 10 and 11 terminating at a lower area which forms an apex, extremity or edge 12. Wall 11 constitutes a lug bottom wall or portion, while wall 10 constitutes a lug side wall or portion. An inner series of resilient components or lugs 13 may be provided offset from the sole edge 6C and staggered relative to the outer series of components and are each of lesser vertical dimension with each including downwardly inclined walls at 14 and 15 terminating at a lower extremity or edge 16. A plane at P1 contains lower edges 12 and 16 of the inner and outer lugs of FIG. 3 and intersects a second plane P2 common to the outer wall 10 of an outer lug 7 and an inclined side 5A of heel wedge 5. While the term "plane" is used in the foregoing description, it will be understood that wall surface 10 may be other than planar as may inclined walls 11 and 14, 15 of lugs 7 and 13. The intersection of P1 and P2 defines an acute included angle at x.

As seen in FIG. 3, the tread member 7 of this particular embodiment has a vertical section that approximates an obtuse triangle. The lower side portion 11 of the triangle extends from a first position on the lower surface of the outer sole 6 located inwardly of the outer edge 6C while the outer side portion 10 extends from a second position on the lower surface located closer to the outer edge 6C than the first position. The second position preferably although not necessarily approximately coincides with the outer edge 6C. The outer side portion 10 therefore makes an obtuse angle with that portion of the lower surface from which it extends. In this embodiment, again referring to FIGS. 3 and 5, the lower side portion 11 also makes an obtuse angle with the lower surface of the sole. It therefore may be appreciated that the tread members of this invention may be characterized in that they generally extend downwardly and outwardly at an obtuse angle to the lower surface of the sole for spreading outwardly upon impact with the ground (See FIG. 5) to dissipate the impact forces away from the foot and leg of the wearer.

With attention now to FIG. 4, mid-sole 4 is shown suitably secured to the underside of upper 1 as by an adhesive and serves to receive the forefoot portion (the right hand half of FIG. 2) of outer sole 6. Outer sole 6 is provided with an outer row or series of tread components or lugs 17 each having an outer wall 18 and a bottom wall 20 converging at a lowermost extremity or edge 21. Inner rows or series of tread components or lugs are indicated at 22 and 23 with the lugs of each row having wall surfaces generally corresponding to those wall surfaces of outer lugs 17 but of a lesser vertical distance resulting in lugs 22–23 being of lesser overall height. Lugs 22 and 23 terminate downwardly in lowermost extremities 24 and 25 within a plane P3 which plane intersects a plane P4 containing outer lug wall 18, at an acute angle at y. While plane P4 is shown as being vertical, the same is preferably outwardly inclined from the side 4A of mid-sole 4.

Now with attention to FIG. 5, showing the heel portion of the present sole construction in foot biased contact with a ground surface S, the lugs 7 are shown displaced laterally outwardly and compressed from their unbiased position of FIG. 3. Subsequently, inner series of lugs 13 are also compressed under foot pressure, deforming upon contact with the ground surface. Importantly, lower edges 12 initially contact the ground surface and flex to cushion initial ground contact with their compression and outward displacement contributing to the cushioning effect. Supplementing the action of lugs 7, and after displacement of same, inner lugs 13 also yield under heel pressure to provide a second stage of shock or impact absorption.

The ground engagement and lateral displacement of outer lugs 7 also contributes toward heel stability. Further, non-uniform displacement and compression of the sole lugs accommodates asymmetrical sole loading as occurs when the runner executes a change of direction. The reduced section side areas of resilient heel wedge 5 and mid-sole 4 will also be, of course, subjected to some degree of compression during ground contact.

In a similar manner, outer lugs 17 of the forefoot portion of the sole are intially displaced upon contact with ground surface S per FIG. 6. Subsequent to initial displacement of outer lugs 17, the inner series of lugs 22 and 23 come into progressive (in a lateral direction) contact with the ground to provide supplementary or secondary cushioning to the forefoot beyond that already provided by the flexing of outer lugs 17.

Forefoot lugs 17, 22 and 23, in addition to cushioning against jarring impact, serve to provide a tread pattern highly adaptable to flexibly encompass rocks, projections and other small obstructions on the ground surface without significantly effecting foot-to-ground relationship or significantly diminishing tread traction. Further, the lugs provide excellent traction and permit independent degrees of lug flexing and compression, advantageous during execution of changes of direction by the wearer.

FIGS. 7, 8 and 9 show sectional views of modified sole constructions corresponding to the typical heel portion sectional view of FIG. 3 of the first described form of the invention. In FIG. 7, an outer sole is indicated at 26 affixed in a suitable manner to a heel wedge 27 with a mid-sole indicated at 28. The heel wedge has outwardly and downwardly sloped sides at 27A for greater resiliency. Outer sole components or lugs are indicated at 30 with laterally spaced series of inner lugs indicated at 31 and 32 each with vertical sidewalls. Lowermost extremities of the lugs 30A, 31A and 32A are within a plane P5 which intersects a plane P6 containing an inclined side of the heel to form an acute included angle w. It will be seen that the lugs 30–32 progressively cushion against ground impact much in the same manner as the first described sole by reason of outer lugs 30 initially contacting the ground with lugs 31 and 32 subsequently engaging and deforming upon surface contact. The lateral extremities of heel wedge 27, being of reduced section, will also compress and deform upwardly relative to the shoe upper to further cushion the foot.

In FIG. 8, an outer sole 35 is affixed to a mid-sole 36 on an upper 1. Mid-sole 36 has outwardly and downwardly inclined sides 36A. Outer sole lugs are indicated at 38 with series of inner lugs at 40 and 41. A plane P7 contains the lowermost extremities or lugs 38 and 40 along one side of the sole. Plane P7 intersects a second plane 28 common to mid-sole side surface 36A and defines an acute included angle z. The cushioning actions of lugs 38, 40 and 41 of the heel portion shown in FIG. 8 are believed obvious in view of the foregoing description of the earlier described cushioning actions.

In FIG. 9, the mid-sole is dispensed with and an outer sole 42 is provided with inclined sidewalls as at 42A extending downwardly and outwardly from a shoe upper 1. The concave lowermost or tread surface 44 of the outer sole is shown without lugs. An arc shown as a line L1 defines the tread surface and intersects a second line L2 projected from outer sole sidewall 42A to define an acute included angle q. Accordingly, the lower side edge of outer sole 42 is of a sectional configuration as to be highly flexible to cushion impact loads.

In the forms of the invention viewed in FIGS. 7, 8 and 9 only the heel portion of the sole is illustrated. When applying the modified forms of the invention to the forefoot portion of the sole, it will be appreciated that the forefoot sole width will be somewhat greater as will be the transverse spacing of the lugs thereon as generally shown in FIG. 4.

In FIG. 10, I show the present invention applied to a conventional shoe or boot sole wherein a separate raised heel at 46 is provided with a row of outer lugs 47 and inner lugs 48 similar to the heel portion lugs 7 and 13 shown in FIG. 3. In continuing similarity to that form of the invention shown in FIGS. 3 through 6, the forefoot sole portion of the sole of FIG. 10 includes multiple rows of outer and inner lugs at 50 and 51 respectively.

With attention now to FIGS. 11 and 12 wherein modified shoe sole construction is indicated generally at 2', parts of the modified shoe sole construction corresponding to parts earlier described in the first form of the invention are identified with prime reference numerals. The sole 2' is of a shoe for the right foot.

The heel portion of the modified sole is approximately the left hand half of the outer sole 6' viewed in FIG. 11 and includes an outer series of resilient components or lugs 7' each having outwardly and downwardly inclined walls (relative the sole major axis A) at 10' and 11' terminating at a lowermost extremity 12'. As with the first embodiment, the downwardly and outwardly inclined resilient tread members or lugs generally form an obtuse angle with the lower surface of the outsole. An inner series of resilient components or lugs 13' may be provided offset from the sole edge and may be staggered relative to the outer series of lugs and are of lesser vertical dimension with each including downwardly inclined walls at 14' and 15' terminating at a lower extremity 16'. A plane P1' contains lower edges 12' and 16' of the inner and outer lugs and intersects a second plane P2' common to the outer wall 10' of an outer lug 7' and an inclined side 5A' of a heel wedge 5' at an acute included angle x'. A mid-sole at 4' also has downwardly and outwardly diverging sidewalls at 4A'. The heel wedge 5' and mid-sole 4' accordingly have side areas of reduced section which contribute to wedge and mid-sole compressibility.

With attention specifically to FIG. 12 the inside of the wearer's right foot will be associated with the left hand side of the Figure. Reinforcing means at 55 is shown as a web extending intermediate some of said outer lugs and serves to reinforce same against severe distortion during maximum loading. The web 55 extends about the curved heel portion of the shoe sole construction and forwardly along the inside edge thereof terminating forwardly approximately at the instep of the shoe. Left foot sole construction would be a mirror image of FIG. 11.

With attention to FIG. 12, it will be seen that the outer lugs 7' are not necessarily of uniform lateral dimension upon comparison of the two lugs illustrated having different lengths indicated respectively at D1 and D2. The length of the outer lug 7' is greater to provide additional support to the inside of the wearer's foot during heel impact with a ground surface and hence reduce the tendency of the ankle to pronate.

The shoe sole material may be a suitable synthetic such as polyurethane, which lends itself to low cost molding operations yet provides the desirable sole qualities of durability and flexibility. A somewhat more costly sole may be of rubber.

While I have shown but a few embodiments of the invention it will be apparent to those skilled in the art that the invention may be embodied still otherwise without departing from the spirit and scope of the invention encompassed within the scope of the appended claim terminology.

I claim:

1. An outer sole for an athletic shoe, which comprises:

a lower surface bounded by a peripheral portion having an outer edge;

means for dissipating shock away from the foot and leg of a wearer comprising a plurality of tread members extending integrally from and disposed about said peripheral portion of said lower surface for supporting said lower surface in a cantilever fashion, certain of said tread members having a vertical section that forms an obtuse triangle having a lowermost apex that extends laterally beyond said outer edge of said outer sole for spreading laterally outwardly upon foot-initiated ground impact.

2. An outer sole for an athletic shoe, comprising:

a lower surface having a central portion and a peripheral portion;

shock absorbing means for cushioning the foot and leg of a wearer against impact loads and for dissipating impact forces laterally outwardly upon impact of the shoe with the ground, said shock absorbing means comprising a plurality of resilient tread members disposed about said peripheral portion of said lower surface to support said central portion in a cantilever fashion, said tread members being inclined downwardly and outwardly from said peripheral portion of said lower surface, said tread members and said central portion of said lower surface cooperating to define a substantially laterally oriented concavity for said outer sole, certain of said tread members having a vertical section that includes a side wall which makes an obtuse angle with said lower surface of said outer sole, said tread members being spread outwardly upon impact with the ground to dissipate said impact forces outwardly away from the foot and leg of the wearer.

3. An outer sole according to claim 2, wherein said certain tread members further include bottom walls, said side walls and bottom walls extending downwardly and outwardly from said lower surface to an area that is resiliently urged laterally outwardly upon impact of the shoe with the ground.

4. An outer sole according to claim 3, wherein said side and bottom walls converge toward one another at said laterally outwardly resiliently urged area.

5. A outer sole according to claim 4, wherein said side walls are substantially planar.

6. An outer sole according to claim 2, wherein said tread members have a lowermost apex which extends laterally beyond the outer edge of said outer sole.

7. An outer sole for an athletic shoe, comprising:

a lower surface having a central portion and a peripheral portion;

shock absorbing means for cushioning the foot and leg of a wearer against impact loads and for dissipating impact forces laterally outwardly upon impact of the shoe with the ground, said shock absorbing means comprising a plurality of resilient tread members disposed about said peripheral portion of said lower surface to support said central portion in a cantilever fashion, said tread members being inclined downwardly and outwardly from said peripheral portion of said lower surface, said tread members and said central portion of said lower surface cooperating to define a substantially laterally oriented concavity for said outer sole, said tread members being shifted outwardly upon impact with the ground to dissipate said impact forces outwardly away from the foot and leg of the wearer, wherein said lower surface includes a heel area having an inside portion and an outside portion, the lateral dimensions of said tread members at said inside and outside portions being non-uniform for reducing ankle pronation.

8. An outer sole as set forth in claim 7, wherein the lateral dimension of said tread members on said inside portion of said heel area is greater than the lateral dimension of said tread members on said outside portion of said heel area.

9. An outer sole for an athletic shoe, comprising:

a lower surface having a central portion and a peripheral portion;

shock absorbing means for cushioning the foot and leg of a wearer against impact loads and for dissipating impact forces laterally outwardly upon impact of the shoe with the ground, said shock absorbing means comprising a plurality of resilient tread members disposed about said peripheral portion of said lower surface to support said central portion in a cantilever fashion, said tread members being inclined downwardly and outwardly from said peripheral portion of said lower surface, said tread members and said central portion of said lower surface cooperating to define a substantially laterally oriented concavity for said outer sole, said tread members being shifted outwardly upon impact with the ground to dissipate said impact forces outwardly away from the foot and leg of the wearer, wherein said lower surface includes a heel area having a web on said peripheral portion extending between said tread members for reducing ankle pronation.

10. An outer sole for an athletic shoe, which comprises:

a lower surface bounded by an outer edge;

means for absorbing and dissipating shock resulting from ground impact comprising a plurality of tread members extending integrally from and disposed about the periphery of said lower surface for supporting said lower surface in a cantilever fashion, certain of said tread members including a lower portion extending downwardly and outwardly from a first position on said lower surface located inwardly of said outer edge and a side portion extending downwardly and outwardly from a second position on said lower surface laterally outwardly of said first position to an area that is urged laterally outwardly upon impact with the ground, said side portion forming an obtuse angle with that portion of said lower surface from which said side portion extends.

11. An outer sole as set forth in claim 10, wherein said side and lower portions converge toward one another at said laterally outwardly urged area.

12. An outer sole as set forth in claim 10, wherein said second position is located approximately at said outer edge of said lower surface.

13. An outer sole as set forth in claim 10, wherein said side portion is substantially planar.

14. An outer sole for an athletic shoe, which comprises:

a lower surface having a central portion bounded by a peripheral portion;

means for absorbing shock resulting from foot-initiated ground impact comprising a plurality of tread members disposed about said peripheral portion of said outer sole and cooperating with said lower surface to define a laterally oriented concavity for said outer sole, certain of said tread members including a side portion and a lower portion, each of which extends downwardly and outwardly at an obtuse angle to said lower surface of said central portion upon contacting the ground.

15. An outer sole as set forth in claim 14, wherein said side portion and said lower portion converge towards one another.

16. An outer sole as set forth in claim 14, wherein said side portion and said lower portion converge towards one another to meet at an area adapted to contact the ground upon impact so as to be urged laterally outwardly.

17. An outer sole as set forth in claims 10, 14, 1 or 2, further comprising a plurality of lug components extending integrally from said lower surface and being positioned inwardly of said tread members, said lug components having a height less than that of said tread members.

18. An athletic shoe, which comprises an upper adapted to receive the foot of a wearer and means for cushioning said foot against impact loads, said cushioning means comprising:

a resilient midsole connected to said upper; and an outer sole fastened to said midsole and having a lower surface bounded by an outer edge, said outer sole including means for absorbing shock comprising a plurality of tread members extending integrally from and disposed about the periphery of said lower surface of said outer sole for supporting said lower surface of said outer sole in a cantilever fashion, certain of said tread members including a lower wall extending at an angle to said lower surface located inwardly of said outer edge and a side wall extending at an obtuse angle to said lower surface downwardly and outwardly from a second position on said lower surface laterally outwardly of said first position, said lower and side walls terminating at an area that is urged laterally outwardly upon impact with the ground.

19. An athletic shoe as set forth in claim 18, wherein said side and lower walls converge toward one another at said laterally outwardly urged area.

20. An athletic shoe, which comprises:

an upper;

a resilient midsole connected to said upper;

an outer sole fastened to said midsole and having a central portion bounded by a peripheral portion; and means for dissipating shock away from the foot and leg of a wearer comprising a plurality of tread members disposed about said peripheral portion of said outer sole, a concavity formed by said tread members and said central portion of said outer sole, certain of said tread members including a side portion and a lower portion, each of said side and lower portions extending downwardly and outwardly at an obtuse angle to said lower surface of said outer sole for being urged laterally outwardly from said central portion of said outer sole upon contacting the ground.

21. An athletic shoe as set forth in claim 20, wherein said side portion and said lower portion converge towards one another to meet at an area adapted to contact the ground upon impact so as to be urged laterally outwardly.

22. An athletic shoe, which comprises:

an upper adapted to receive the foot of a wearer;

a resilient midsole connected to said upper;

an outer sole fastened to said midsole and having a lower surface composed of a central portion and a peripheral portion bounded by an outer edge; and shock absorbing means for cushioning the foot and leg of a wearer against impact loads and for dissipating impact forces laterally outwardly upon impact of the shoe with the ground, said shock absorbing means comprising a plurality of resilient tread members disposed about said peripheral portion of said lower surface to support said central portion in a cantilever fashion, said tread members being inclined downwardly and outwardly at an obtuse angle to said lower surface for spreading outwardly upon impact with the ground to dissipate said impact forces outwardly away from the foot and leg of the wearer.

23. An outer sole according to claim 22, wherein said tread members include side walls and bottom walls extending downwardly and outwardly from said lower surface to an area that is resiliently urged laterally outwardly upon impact of the shoe with the ground.

24. An outer sole according to claim 23, wherein said side and bottom walls converge toward one another at said laterally outwardly resiliently urged area.

25. An outer sole according to claim 24, wherein said side walls are substantially planar.

26. An outer sole according to claim 22, wherein said tread members have a lowermost apex which extends laterally beyond the outer edge of said outer sole.

27. An athletic shoe, which comprises:

an upper adapted to receive the foot of a wearer;

a resilient midsole connected to said upper and having a downwardly and outwardly inclined outer wall; and an outer sole fastened to said midsole and having a lower surface with a central portion bounded by an outer edge, said outer sole including shock absorbing means for cushioning the foot and leg of a wearer against impact loads and for dissipating impact forces laterally outwardly upon impact of the shoe with the ground, said shock absorbing means comprising a plurality of tread members disposed about the periphery of said lower surface, a concavity formed by said tread members and said central portion of said outer sole, each of said tread members including a side wall extending downwardly and outwardly from said outer edge of said outer sole substantially collinearly with said inclined outer wall of said midsole and a lower wall that extends downwardly and outwardly from said lower surface of said outer sole to a position where it meets said side wall for spreading laterally upon ground impact.

28. An athletic shoe as set forth in claim 27, further comprising a resilient heel wedge positioned between the heel portions of said midsole and said outer sole, said heel wedge also having a downwardly and outwardly inclined outer wall which is substantially colinear with said inclined outer wall of said midsole.

29. An athletic shoe as set forth in claims 18, 20, 22 or 27 further comprising a plurality of lug components extending integrally from said lower surface and being positioned inwardly of said tread members, said lug components having a height less than that of said tread members.

30. An athletic shoe as set forth in claims 18, 20, 22 or 27 wherein said midsole includes a reduced section side area positioned above said tread members which is compressed upon ground impact for providing additional resiliency and shock-absorption.

31. An athletic shoe as set forth in claims 18, 20, 22 or 27, further comprising a resilient heel wedge positioned between the heel portions of said midsole and said outer sole, said heel wedge having a reduced section side area positioned above said tread members which is compressed upon ground impact for providing additional resiliency and shock-absorption.

32. An athletic shoe, which comprises:

an upper;

a resilient midsole connected to said upper;

an outer sole fastened to said midsole and having a lower surface including a peripheral portion having an outer edge; and means for dissipating shock away from the foot and leg of a wearer comprising a plurality of tread members extending integrally downwardly and outwardly from and disposed about said peripheral portion of said lower surface, certain of said tread members having a vertical section that includes a side wall which makes an obtuse angle with said lower surface of said outer sole, and a lower area that extends laterally at least partially beyond said outer edge whereby said certain tread members spread laterally outwardly from said peripheral portion upon foot-initiated ground impact.

33. An outer sole, which comprises:

a lower surface having a central portion and a peripheral portion bounded by an outer edge; and shock absorbing means for cushioning the foot and leg of a wearer against impact loads and for dissipating impact forces laterally outwardly upon impact of the shoe with the ground, said shock absorbing means comprising a plurality of resilient tread members disposed about said peripheral portion of said lower surface, said tread members being inclined downwardly and outwardly at an obtuse angle to said lower surface for spreading outwardly upon impact with the ground to dissipate said impact forces outwardly away from the foot and leg of the wearer.

34. An outer sole as set forth in claim 33, wherein said lower surface includes a heel area having an inside and an outside portion, the lateral dimensions of said tread members at said inside and outside portions being non-uniform.

35. An outer sole as set forth in claim 34, wherein the lateral dimension of said tread members on said inside portion of said heel area is greater than the lateral dimension of said tread members on said outside portion of said heel area.

36. An outer sole as set forth in claim 33, wherein said lower surface includes a heel area having a web on said peripheral portion extending between said tread members for reducing ankle pronation.

37. An outer sole as set forth in claim 33, wherein said tread members have a lowermost apex that extends laterally beyond said outer edge of said outer sole for spreading laterally outwardly upon foot-initiated ground impact.

38. An outer sole as set forth in claim 33, wherein said tread members and said central portion of said lower surface cooperate to define a substantially laterally oriented concavity for said outer sole.

39. An outer sole as set forth in claim 33, wherein said tread members include side walls and bottom walls extending downwardly and outwardly from said lower surface to an area that is resiliently urged laterally outwardly upon impact of the sole with the ground.

40. An outer sole as set forth in claim 39, wherein said side and bottom walls converge toward one another at said laterally outwardly resiliently urged area.

41. An outer sole as set forth in claim 39, wherein said area extends at least partially beyond said outer edge.

42. An outer sole as set forth in claim 39, wherein each of said sole and bottom walls extends downwardly and outwardly at an obtuse angle to said lower surface.

43. An outer sole as set forth in claim 33, further in combination with a resilient midsole located adjacent said outer sole, said midsole including a reduced section side area positioned above said tread members which is compressed upon ground impact for providing additional resiliency and shock-absorption.

* * * * *

UNITED STATES PATENT AND TRADEMARK OFFICE

CERTIFICATE OF CORRECTION

PATENT NO. : 4,372,058

DATED : February 8, 1983

INVENTOR(S) : Jerry D. Stubblefield

It is certified that error appears in the above—identified patent and that said Letters Patent is hereby corrected as shown below:

Column 1, line 49, change "orientated" to --and/or laterally oriented--.

Column 2, line 65, change "insiole" to --insole--.

Column 3, line 3, after "wedge" insert --5--.

Column 12, line 18, change "sole" to --side--.

Signed and Sealed this

Tenth Day of May 1983

[SEAL]

*Attest:*

GERALD J. MOSSINGHOFF

*Attesting Officer*

*Commissioner of Patents and Trademarks*